United States Patent [19]

Miyazawa

[11] Patent Number: 4,986,339

[45] Date of Patent: Jan. 22, 1991

[54] PROCESS AND APPARATUS FOR CONTINUOUS SHEET CASTING BY TWIN ROLLS

[75] Inventor: Kenichi Miyazawa, Kawasaki, Japan

[73] Assignee: Nippon Steel Corporation, Tokyo, Japan

[21] Appl. No.: 388,800

[22] Filed: Aug. 3, 1989

[30] Foreign Application Priority Data

Aug. 3, 1988 [JP] Japan ..... 63-192758

[51] Int. Cl.[5] ..... B22D 11/06; B22D 11/10

[52] U.S. Cl. ..... 164/466; 29/116.2; 29/132; 164/428; 164/480; 164/502

[58] Field of Search ..... 164/466, 467, 480, 428, 164/502, 503; 29/116.2, 132

[56] References Cited

FOREIGN PATENT DOCUMENTS

| | | | |
|---|---|---|---|
| 57-94456 | 6/1982 | Japan . | |
| 59-153551 | 9/1984 | Japan | 164/466 |
| 60-106651 | 6/1985 | Japan | 164/466 |
| 60-162558 | 8/1985 | Japan . | |
| 60-166146 | 8/1985 | Japan . | |
| 60-170559 | 9/1985 | Japan . | |
| 60-221155 | 11/1985 | Japan . | |
| 61-7137 | 3/1986 | Japan . | |
| 61-144245 | 7/1986 | Japan . | |
| 62-118951 | 5/1987 | Japan | 164/466 |
| 63-80944 | 4/1988 | Japan | 164/428 |
| 63-93454 | 4/1988 | Japan | 164/466 |
| 63-97341 | 4/1988 | Japan | 164/428 |

OTHER PUBLICATIONS

*Casting of Near Net Shape Products*, Fall Extractive and Process Meeting, Honolulu, Hawaii, The Metallurgical Society, Nov. 13-17, 1988, pp. 583-593.

Material and Process, vol. 1, No. 2, 1988, p. 389.

*Primary Examiner*—Richard K. Seidel

*Assistant Examiner*—J. Reed Batten, Jr.

*Attorney, Agent, or Firm*—Pollock, Vande Sande & Priddy

[57] ABSTRACT

Molten metal is continuously poured into the space defined by a pair of rolls (10A, 10B; 30A, 30B) positioned parallel to each other and rolling the poured molten metal while causing it solidify gradually, in which a pair of rolls are used which is constructed in a manner that a plurality of paramagnetic material zones (14, 16; 34, 36) and a plurality of ferromagnetic material zones (18, 20, 22; 38, 40) are alternately and integrally combined in the direction of axis, all of the ferromagnetic material zones of the two rolls are opposite to one another, by the action of magnets (24, 26; 50X, 50Y) positioned outside or inside the rolls. Magnetic circuits are formed in two places arbitrarily selected in the direction of axis between the ferromagnetic material zones and the magnets which are opposite to one another between the two rolls, molten metal is continuously supplied to the gap of the rotating rolls while this condition is maintained, and the flow of molten metal to outside the magnetic fields in the direction of roll axis is prevented by the magnetic fields generated between the opposite rolls in the above-mentioned two places, whereby the casting width is controlled. It is desirable that at least two ferromagnetic material zones be provided on the shaft end sides of the two rolls with the middle portion (14; 34) of the roll length serving as the center of symmetry.

15 Claims, 5 Drawing Sheets

PROCESS AND APPARATUS FOR CONTINUOUS SHEET CASTING BY TWIN ROLLS

BACKGROUND OF THE PRESENT INVENTION

This invention relates to a process and apparatus for continuous casting by twin rolls that involves producing cast pieces in the form of sheets directly from molten metal.

The process for casting metal sheets by pouring molten metal into the space defined by a pair of rotating rolls opposite to each other is known as the twin roll process. In this process, molten metal is poured from above into the space defined by the two rolls positioned parallel to each other at an appropriate interval. This molten metal is brought into contact with the rolls and is cooled, with the result that a solidified shell is formed on the surface of each roll. The two solidified shells thus formed move downward as the rolls rotate and, at the same time, they increase in thickness through the heat removal by the rolls. When the two solidified shells with increased thickness reach a place where the space narrows, they are joined into one piece and rolled to a casting with a specified thickness, which is continuously withdrawn to below the rolls.

In this continuous casting process by twin rolls, molten metal also flows in the direction parallel to the roll axis when it is poured into the space defined by the rolls. For this reason, part of molten metal flows out without solidification from both ends of each roll if the rotating speed of the rolls is too low for the flow rate of molten metal.

In known casting processes, side dams are provided at both ends of each rotating roll to prevent this outflow of molten metal. Fixed side dams which are divided into top and bottom portions are used as disclosed in the Japanese Patent Unexamined Publications (called Tokkyo Kokai) Nos. 60-162558 and 61-144245, for example, and the vibrating side dam method is disclosed in Tokkyo Kokai Nos. 60-166146 and 60-170559. The process disclosed in Tokkyo Kokai No. 60-221155 is also known; in this process side dams are installed inward from both ends of each roll, not at both ends.

In the continuous caster of metal sheets disclosed in Tokkyo Kokai No. 57-94456, a pair of rotating bodies (i.e., rolls) positioned in parallel to each other are each adapted to move in the direction of axis and in the directions at right angles to this directions of axis and are used in a manner that the two rolls are mutually shifted in the direction of axis. A pair of sheet width controlling plates each of which has a circular-arc-shaped side edge conforming to the shape of the peripheral surface of the roll barrel are used. One controlling plate is positioned so as to be in contact with an end of one roll at a main surface of it and also be in contact with the peripheral surface of the other roll at the circular-arc-shaped side edge of it; the other controlling plate is positioned so as to be in contact with an end of the other roll at a main surface of it and also be in contact with the peripheral surface of the above-mentioned one roll at the circular-arc-shaped side edge of it. This construction enables metal sheets with different thicknesses and/or widths to be produced selectively.

In the continuous sheet casting by twin rolls, variable-width casting techniques are very important because requirements for widths of castings or cast products are very diverse. It is also important that castings have good edge shapes. In the casting process in which side dams are provided at roll ends, the width of a casting is equal to the roll length and it is impossible to change the width of the casting. Furthermore, when the side dam surface is shaved by fins generated between the roll end and side dam surface and by solidified metal formed on the side dam surface, molten metal flows out of a clearance resulting from this shaving or it drops onto the casting surface. As a result, it is difficult to continuously cast good sheets.

In the process in which side dams are installed inward from both roll ends, it is difficult to continuously cast sheets with good edge shapes and uniform width because fins are formed and molten metal leaks between the peripheral roll surface and the side dam edge.

When no side dams are used and the outflow of molten metal from roll ends is prevented by setting the rotating speed of the rolls at a high value relative to the flow rate of molten metal, the casting has serrated edges. In this case, therefore, it is very difficult to make uniform the casting width in the longitudinal direction of the casting and it is also exceedingly difficult to change the casting width.

When the cast piece has bad edge shapes and nonuniform widths, it is usually necessary to cut casting edges and make the width uniform in the manufacturing process, lowering the yield and adding to the number of work steps.

A casting process in which side dams are not used is also known. This process is disclosed in the specification of Japanese Patent Application (Tokugan Sho) No. 63-93060 submitted by the present applicant. This process uses a pair of rolls, each composed of a main body of stainless steel as a paramagnetic material and two ferromagnetic material (ferrite) zones that are provided along the full periphery of the main body in a manner that they are spaced each other in the direction of axis and have a relatively small width in the direction of axis. These rolls are positioned in parallel to each other with a small gap corresponding to the thickness of the cast sheet and the ferromagnetic material zones are provided opposite to each other. A pair of permanent magnet is positioned above the rolls. One of the magnetic poles of a permanent magnet faces one of the ferromagnetic material zones of one roll with a small gap therebetween, and the other magnetic pole faces one of the ferromagnetic material zones of the other roll with a small gap therebetween. One of the magnetic poles of another magnet faces the other ferromagnetic material zone of the above-mentioned one roll with a small gap therebetween and the other magnetic pole faces the other ferromagnetic material zone of the above-mentioned other roll with a small gap there between. As a result, in the positions opposite to the poles of a permanent magnet a ferromagnetic material zone of one roll is magnetized with an N pole, for example, and that of the other roll is magnetized with an S pole. This means that the mutually nearest portions of the ferromagnetic material zones opposite between the rolls are also magnetized with mutually reverse polarity. Therefore, two magnetic fields are formed between the ferromagnetic material zones spaced in two places in the direction of axis of one roll and the ferromagnetic material zones spaced in two places in the direction of axis of the other roll. These magnetic fields act on the pool of molten metal supplied from an upper nozzle toward the space defined by the rolls, enabling a cast sheet with good shapes of both edges (i.e., nonserrated edges) to be produced. The same technique as disclosed in this specification of Tokugan Sho No. 63-93060 is disclosed in "Material and Process", Vol. 1 (1988), No. 2 (Mar. 4, 1988, published by the Iron and Steel Institute of Japan, page 389) and "Casting of Near Net Shape Products" (a collection of lectures delivered at the International Symposium on Casting of Near Not Shape Products held on Nov. 13 to 17, 1988, in Honolulu, Hi., pages 583–593).

The manufacturing process of metal sheets disclosed in the Japanese Patent Examined Publication (called Tokkyo Kohkoku) No. 61-7137 (corresponding to Tokkyo Kokai No. 57-177861) is similar to these processes. Permanent magnets are used in the process disclosed in Tokkyo Kohkoku No. 61-7137. Each inside of both ends of pair of cooling drums opposite to each other is provided with a pole of a permanent magnet of mutually reverse polarity and the two poles of the permanent magnet are opposite to each other through the walls of the cooling drums. The magnetic fields formed through the walls of the cooling drums will act in the same manner as in the above-mentioned techniques. The apparatus disclosed in Tokkyo Kokai No. 63-97341 also has the same constitution as that of the technique disclosed in Tokkyo Kohkoku No. 61-7137.

Although these techniques based on the use of magnetic forces are superior to those based on the use of side dams, it is impossible to selectively produce castings with good shapes of both edges and various sheet widths.

BRIEF SUMMARY OF THE INVENTION

It is therefore the principal object of this invention to provide a process and apparatus for stably producing cast sheets with good shapes of both edges and uniform width using magnetic forces while keeping a high yield, which enable the cast sheet width to be varied.

To achieve this object, according to a feature of this invention there is provided a continuous sheet casting process by twin rolls for producing cast sheets by continuously pouring molten metal into the space defined by a pair of rolls arranged parallel to each other and rolling the poured molten metal while causing it to solidify gradually, in which a pair of rolls are used. The rolls can be internally cooled and are constructed in a manner that a plurality of paramagnetic material zones and at least three ferromagnetic material zones are alternately and integrally combined in the direction of axis. All of the ferromagnetic material zones of the two rolls positioned parallel to each other are opposite to each other. By the action of magnets positioned outside or inside of the rolls, magnetic circuits are formed in two places arbitrarily selected in the direction of axis between the ferromagnetic material zones and the magnets. Under this conditions, molten metal is continuously supplied to the space of the rotating rolls, and the flow of molten metal to the direction of roll axis is prevented by the magnetic fields generated between the two rolls in the above-mentioned two places, whereby the width of a casting is controlled.

According to another feature of this invention there is provided a twin roll type continuous sheet casting apparatus for producing cast sheets by continuously pouring molten metal into the space defined by a pair of opposite rolls positioned parallel to each other and rolling the poured molten metal by causing it to solidify gradually, in which each roll can be internally cooled and is constructed in a manner that at least four paramagnetic material zones and at least three ferromagnetic material zones extending along the full periphery of each roll are combined alternately and integrally in the direction of axis, all of the ferromagnetic material zones of the two rolls are opposite to one another, magnets that can magnetize the ferromagnetic material zones opposite to one another between the two rolls by forming magnetic circuit between the ferromagnetic material zones in two places arbitrarily selected in the direction of axis are positioned outside or inside of the rolls, and a means of continuously supplying molten metal to the space defined by a pair of rolls between the ferromagnetic material zones in two places selectively magnetized is positioned above the two rolls.

According to still another feature of this invention there are provided rolls used in a twin roll type continuous sheet casting apparatus for producing cast sheets by continuously pouring molten metal into the space defined by a pair of rolls positioned parallel to each other and rolling the poured molten metal while causing it to solidify gradually, in which each roll can be internally cooled and is constructed in a manner that at least four paramagnetic material zones and at least three ferromagnetic material zones extending along the full periphery of each roll are combined alternately and integrally in the direction of axis.

Austenitic stainless steel, for example, may be used as a paramagnetic material for rolls and plain carbon steel, for example, may be used as a ferromagnetic material for rolls. The reason why at least three ferromagnetic material zones are provided is that cast sheets of at least two different widths can be produced if two of these zones are arbitrarily selected and magnetized and molten metal is supplied to the gap between the two magnetized regions. It is desirable that at least two ferromagnetic material zones are provided on each halt length range of the two rolls with the middle portion of the roll length serving as the center of symmetry. In this case, it is possible to produce cast sheets with at least four different widths by arbitrarily selecting and magnetizing two ferromagnetic material zones and supplying molten metal to the middle portion of the roll length. By changing the magnet position, it is possible to magnetize any two places in the roll length and thereby to produce cast sheets with different widths even when the whole roll is made of a ferromagnetic material. In this case, however, a magnetic field concentrated on a limited area cannot be generated and, therefore, it is impossible to conduct accurate control of the casting width.

According to this invention, it is possible to vary the cast sheet width by changing selectively magnetized zones in two places and, therefore, the interval of magnetic fields for each of different casting operations or during one casting operation. Other features of this invention will be apparent from the following description taken in connection with the accompanying drawings.

DETAILED DESCRIPTION OF THE INVENTION

Figure 1:
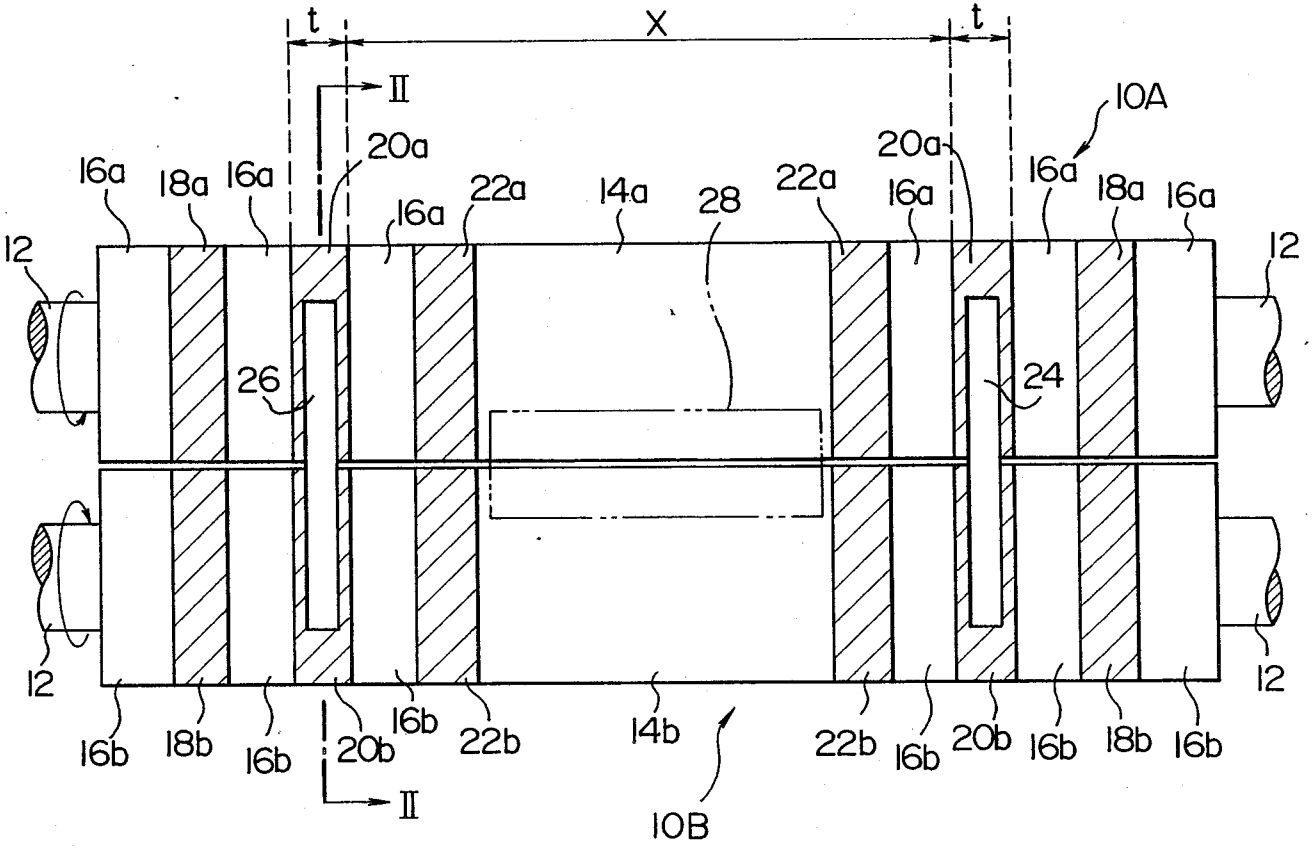
FIG. 1 is a plan view of a pair of rolls, magnets and a nozzle for pouring molten metal in the twin roll type continuous sheet casting apparatus.

FIG. 1 shows, as a plan view, a pair of rolls arranged parallel to each other, which are the main components of the twin roll type continuous sheet casting apparatus. Cylindrical rolls 10A and 10B, each having a roll shaft 12 supported by frame members (not shown) through bearings as an integral part, are formed as known structures internally water-cooled. The roll 10A is a structure in which one cylindrical paramagnetic material zone 14*a* in the middle portion in the direction of axis, six cylindrical paramagnetic material zones 16*a* arranged symmetrically with respect to this middle portion on the shaft end sides of both rolls and six cylindrical ferromagnetic material zones 18*a*, 20*a* and 22*a* similarly positioned symmetrically with respect to the middle portion are alternately combined in the direction of axis. The paramagnetic material zones 16*a* have a smaller length in the direction of axis (called width in this specification) than the paramagnetic material zone 14*a*. The ferromagnetic material zones 18*a*, 20*a* and 22*a* are each positioned between a plurality of paramagnetic material zones 16*a* and 14*a*. Therefore, the gaps between the zones 18*a*, 20*a* and 22*a* are determined by the width of the zones 16*a*. The description of the roll 10A may be applied to the roll 10B by replacing the letter "a" added to each reference numeral with "b" and the description of the construction of the roll 10B is omitted. The same applies to the following descriptions.

The apparatus of this invention is provided with a pair of magnets 24 and 26 that are approximately of the shape of U as a whole and may be electromagnets or permanent magnets. Each of the magnets 24 and 26 is supported by supporting members (not shown) so that the two free ends (N and S poles) can approach (refer to FIG. 2) or go away from the ferromagnetic material zones of the rolls 10A and 10B opposite to each other. The magnets 24 and 26 are selectively positioned so that they are opposite to any of the ferromagnetic material zones 20*a* and 20*b*, each situated on the reverse side with respect to the paramagnetic material zones 14*a* and 14*b*, (preferably, the zones in symmetrical positions as shown in FIG. 1).

A known slit nozzle 28 for supplying molten metal from above to the space defined by the rolls 10A and 10B is of a shape elongated in the direction of roll axis along this space and is positioned so as to be opposite to the paramagnetic material zones 14*a* and 14*b*.

Figure 2:
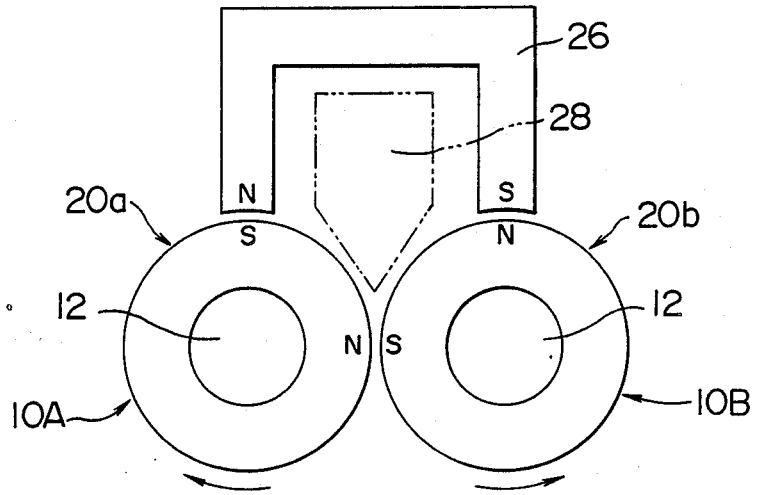
FIG. 2 is a schematic section view taken on line II—II in FIG. 1.

Referring now to FIGS. 1 and 2, if the N and S poles of the magnet 26 are caused to approach the ferromagnetic material zones 20*a* and 20*b*, for example, the magnetic fields generated from the magnet 26 propagate through the ferromagnetic material zones 20*a* and 20*b*. As a result, the N and S poles of a magnet are formed on the surfaces of the ferromagnetic material zones 20*a* and 20*b* and a magnetic field is generated in the space between the ferromagnetic material zones 20*a* and 20*b*. The stronger the magnetic force of the magnet 26, the higher the intensity of this magnetic field. Furthermore, the intensity of this magnetic field increases as the N and S poles of the magnet 26 approach the ferromagnetic material zones 20*a* and 20*b*, each not becoming in contact with the zones 20*a* and 20*b*. Moreover, the intensity of this magnetic field increases with decreasing gap between the opposite portions of the rolls 10A and 10B.

If, similarly, the magnet 24 is caused to approach the ferromagnetic material zones 20*a* and 20*b* on the other side, a strong magnetic field is generated in the space between the ferromagnetic material zones 20*a* and 20*b* on the other side.

FIG. 1 shows a case where strong magnetic fields are generated in the gaps between the ferromagnetic material zones 20*a* and 20*b* in two places using two magnets 24 and 26. It is possible to generate strong magnetic fields in the roll gaps in the specified positions of the ferromagnetic material zones by moving these two magnets closer to another pair of ferromagnetic material zones or, for example, by switching power sources for six electromagnets installed near six pairs of ferromagnetic material zones 18*a*, 20*a* and 20*a*.

When molten metal moves in a magnetic field at a speed, the molten metal is subjected to an electromagnetic force in the direction opposite to this movement and the movement of molten metal is suppressed. When molten metal is poured through the nozzle 28 into the space defined by the rotating rolls, molten metal also flows in irregular flows in the direction of roll axis and the flow of molten metal and the vibration of the meniscus are suppressed in the gaps between the ferromagnetic material zones 20*a* and 20*b* in two places where strong magnetic field are generated and cast pieces with uniform width and good shapes of edges can be produced.

A case where strong magnetic fields are generated in the gaps between the ferromagnetic material zones 20*a* and 20*b* in two places is considered with respect to the casting width. If the distance between the ferromagnetic material zones 20*a* in two places shown in FIG. 1 is denoted by x and the length of these ferromagnetic material zones in the direction of roll axis (i.e., width) is denoted by t, the casting width is almost equal to the value of x in the case of strong magnetic fields and is equal to the value of $x+2t$ in the case of relatively weak magnetic fields. Thus it is possible to change the casting width between x and $x+2t$ by changing the intensity of magnetic fields.

When the casting width is to be changed substantially, strong magnetic fields generated in the gaps between the ferromagnetic material zones 18*a* and 18*b* in two places in FIG. 1 result in a casting width almost equal to the gaps between the ferromagnetic material zones 18*a* and 18*b* in two places; thus the casting width increases substantially. When strong magnetic fields are generated in the gaps between the ferromagnetic material zones 22*a* and 22*b* in two places, the casting width is almost equal to the gaps between the ferromagnetic material zones 22*a* and 22*b* in two places and, therefore, the casting width can be decreased substantially.

Incidentally, it is possible to substantially vary the casting width not only for each cast but also during casting by rapidly changing the position of magnetic field in the roll gap FIGS. 1 and 2 show a case where ferromagnetic material zones are combined in six places in the direction of roll axis. In this case, the casting width can be further substantially varied by lengthening the roll length and, at the same time, by increasing the number of ferromagnetic material zones.

Even in composite rolls composed of a different materials illustrated in FIGS. 1 and 2, it is possible to cool the inside of the rolls by providing it with a passage for introducing a cooling medium and it is desirable that the roll inside be cooled when molten metal at high temperatures is cast for a relatively long time.

When the frequency of surface grinding of composite rolls composed of different materials is too high, a difference in the surface level occurs at the boundary between the ferromagnetic material zones and the paramagnetic material zones due to a difference in the wear speed. It is necessary to prevent this difference in the level because it results in variations in the casting thickness in the transverse direction. This difference in the level can be prevented by providing a thin coating layer of a paramagnetic material or a thin-walled cylinder of a paramagnetic material on the roll surface, thereby forming a new roll surface. Incidentally, the thickness of the coating layer and thin-walled cylinder is preferably 3 mm or less. The smaller this thickness, the stronger the intensity of the magnetic field in the roll gap; a small thickness is favorable for suppressing the flow of molten metal in the direction of roll axis and the vibration of the meniscus.

The above-mentioned coating is applied, for example, by the low-pressure plasma spraying process, the usual spraying process under atmospheric pressure and the electroplating process. The coating layer formed by these processes is subjected to surface grinding as required.

EXAMPLE 1

A pair of twin rolls were composed by alternately incorporating iron cylinders of ferromagnetic material in rolls of austenitic stainless steel (paramagnetic material) 300 mm in length and 100 mm in outer diameter. D.C. magnetic fields were generated in two places of the roll gap using electromagnets and molten tin was poured into the space defined by rolls through a slit nozzle.

In FIG. 1, the width of the ferromagnetic material zones was 15 mm, the width of the paramagnetic material zones 14*a* and 14*b* in the middle portion of the rolls was 90 mm, the width of the paramagnetic material zones 16*a* and 16*b* was 20 mm, the diameter of the roll shafts of paramagnetic material 12 was 60 mm. Sheets were cast by varying the magnetic flux density between the rolls in the range from 0 to 1.0 tesla, the rotating speed of the rolls in the range from 80 to 250 rpm, and the flow rate of poured molten tin in the range from about 0.14 to 0.5 kg/sec and changing the place of generation of a magnetic field between the roll gap variously as in the following three cases:

Case 1 Magnetic fields were generated in the gaps between the ferromagnetic material zones 22*a* and 22*b* in two places shown in FIG. 1.

Case 2 Magnetic fields were generated in the gaps between the ferromagnetic material zones 20*a* and 20*b* in two places.

Case 3 Magnetic fields were generated in the gaps between the ferromagnetic material zones 18*a* and 18*b* in two places.

As a result, only cast sheets with serrated edges were obtained when no magnetic field was generated, whereas when magnetic fields were generated, cast sheets about 0.2 to 0.5 mm in thickness could be produced with a uniform width of about 90 to 120 mm in Case 1, with a uniform width of about 160 to 190 mm in Case 2, and with a uniform width of about 230 to 260 mm in Case 3. Thus it became apparent that the casting width can be varied substantially.

EXAMPLE 2

Figure 3:
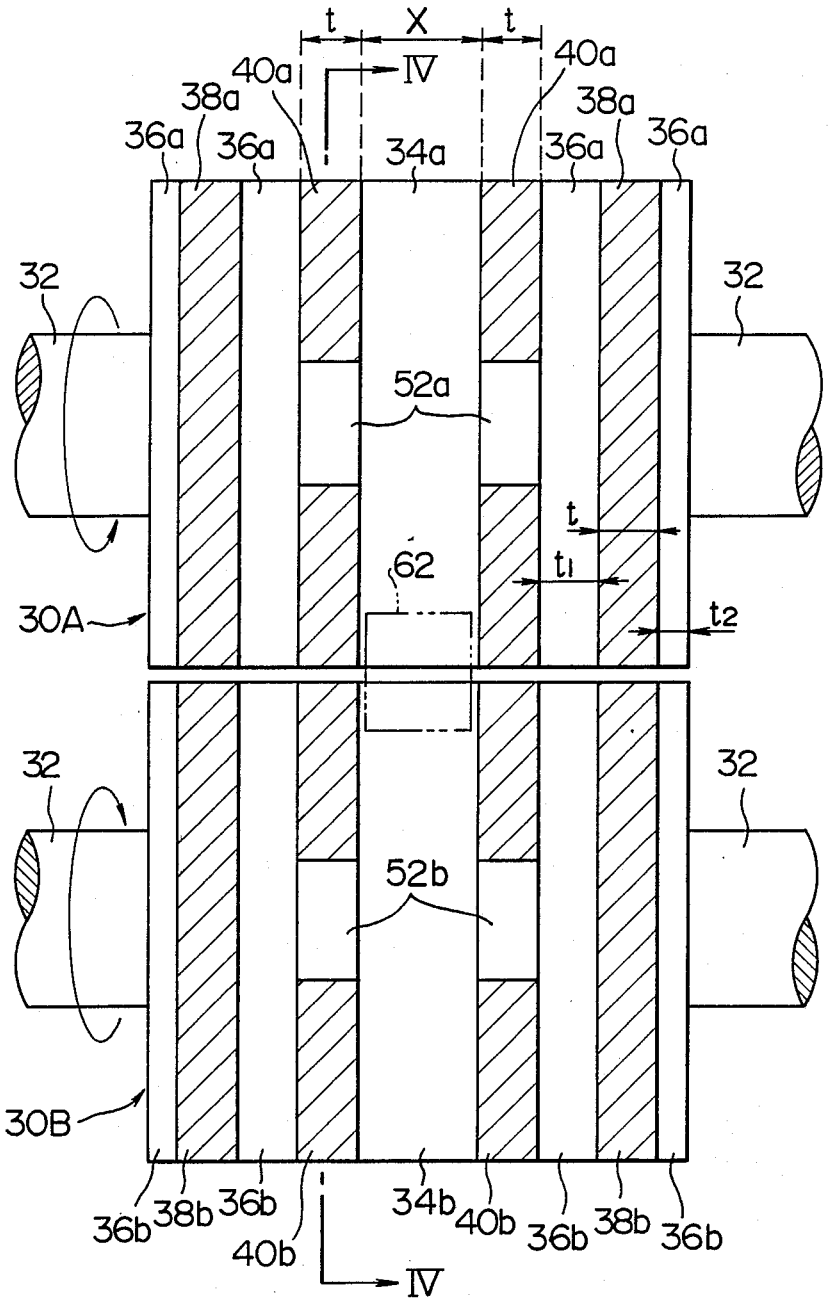
FIG. 3 is a plan view, similar to FIG. 1, of a pair of rolls, magnets and the nozzle of the twin roll type continuous sheet casting apparatus which is an other example of variation.
Figure 4:
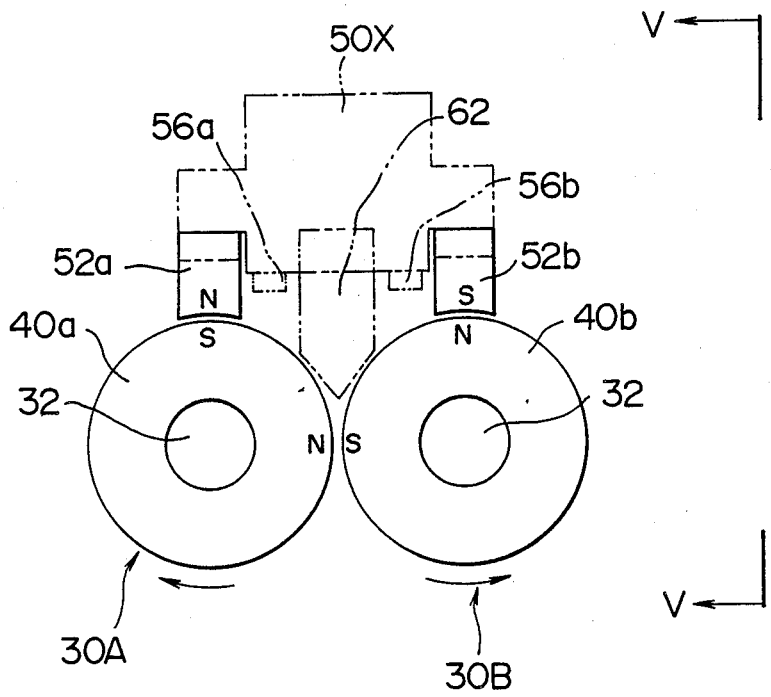
FIG. 4 is a schematic section view taken on line IV—IV in FIG. 3.
Figure 5:
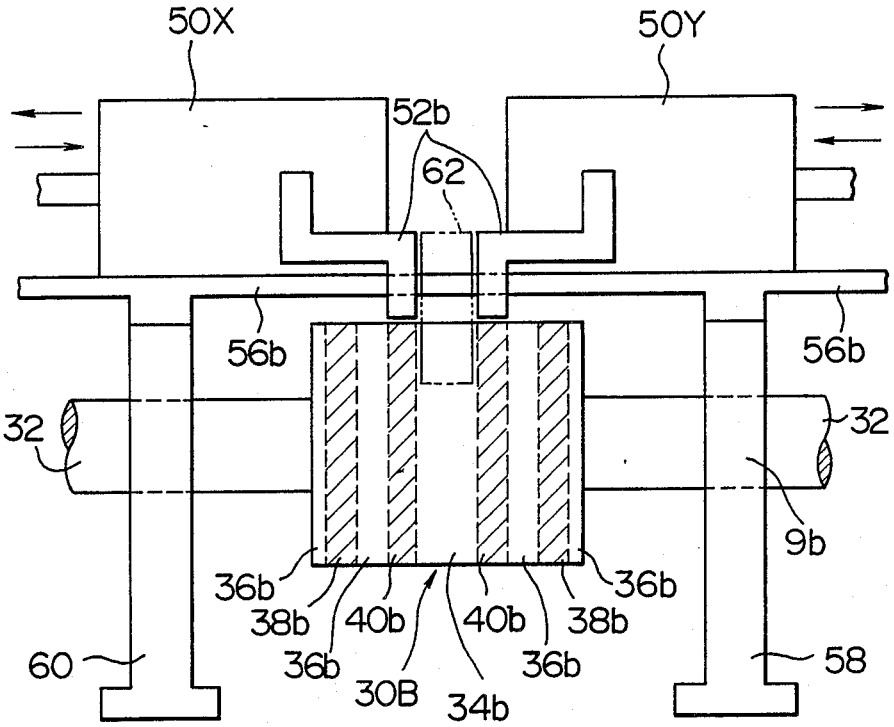
FIG. 5 is a schematic side view taken in the direction of the arrows substantially along the line V—V in FIG. 4.

The apparatus shown in FIG. 3 to FIG. 5 was used. The rolls 30A and 30B used in this apparatus are of the same construction as that of the above-mentioned rolls 10A and 10B with the exception of the diameter to length ratio, the number of ferromagnetic material zones and the combination of ferromagnetic material zones and paramagnetic material zones. Therefore, each part of the rolls 30A and 30B is denoted by adding the numerals 20 to each reference numeral of the rolls 10A and 10B and the description of the basic construction of the rolls 30A and 30B is omitted. In the roll 30A (as with the roll 10B, the description of the roll 30B is omitted), paramagnetic material zones 34*a* and 36*a* are made of austenitic stainless steel and ferromagnetic material zones 38*a* and 40*a* are made of plain carbon steel. The widths X, t1 and t2 of the paramagnetic material zones are 100 mm, 50 mm and 25 mm, respectively, and the width t of the ferromagnetic material zones 38*a* and 40*a* is 50 mm. The whole surface of the roll 30A is covered with a thin layer of austenitic stainless steel 1 mm in thickness.

A pair of D.C. electromagnets 50X and 50Y juxtaposed to the rolls 30A and 30B support iron yokes 52*a* and 52*b*, respectively (the polarity of the yoke 52*a* is different from that of 52*b* and both form a pair). The free end of the yoke 52*a* approaches one of the ferromagnetic material zones 38*a* and 40*a* of the roll 30A and becomes opposite to it with a gap of 2 mm. The free end of the yoke 52*b* approaches one of the ferromagnetic material zones 38*b* and 40*b* of the roll 30B and becomes opposite to it with a gap of 2 mm. The face of the free end (of rectangular shape) of each yoke has a length of 50 mm in the direction of roll axis and a length of 100 mm in the direction of roll periphery. The electromagnets 50X and 50Y are are installed on guide rails of austenitic stainless steel 56*a* and 56*b* supported by legs 58 and 60, respectively, in a manner that they can slide only in the longitudinal direction of the guide rails. These electromagnets 50X and 50Y can be selectively moved by two drives using high-speed pulse motors individually along the guide rails 56*a* and 56*b* together with the yokes 52*a* and 52*b*. The magnetic flux density in each magnetic circuit formed in the electromagnets 50X and 50Y, yokes 52*a* and 52*b* and ferromagnetic material zones of each roll was 2 tesla for a gap between the two rolls of 1 mm and 1.5 tesla for a roll gap between the two rolls of 2 mm when the power input to the electromagnets was 8 kVA.

A slit nozzle 62 for supplying molten metal installed for the rolls 30A and 30B is positioned above the rolls so that it can supply molten metal to the space defined by rolls in a position opposite to the two paramagnetic material zones 34*a* and 34*b*.

In this experiment, cast sheets were produced by supplying molten stainless steel with a composition of Fe-18 wt. % Cr-8 wt. % Ni through the nozzle 62. The experiment was conducted in the following three cases:

Case 1

With the positions of the electromagnets fixed during casting, magnetic fields were generated in the gaps between the ferromagnetic material zones 40*a* and 40*b* in two places by varying the rotating speed of the rolls between 20 and 200 rpm and the flow rate of molten metal between 0.4 and 2.5 kg/s for each cast. As a result, it was found that stainless steel sheets with uniform width and good properties can be cast with a cast thickness in the range of 0.4 to 1.3 mm and a cast width in the range of 10 to 20 cm.

Case 2

With the positions of the electromagnets fixed during casting, magnetic fields were generated in the gaps between the ferromagnetic material zones 38*a* and 38*b* in two places by varying the rotating speed of the rolls between 20 and 200 rpm and the flow rate of molten metal between 1.3 and 5.1 kg/s for each cast. As a result, it was found that stainless steel sheets with uniform width and good properties can be cast with a cast thickness in the range of 0.4 to 1.3 mm and a cast width in the range of 30 to 40 cm.

Case 3

Moving the positions of the electromagnets 50X and 50Y parallel to each other in the direction of roll axis during casting, the positions of magnetic field were changed during casting so that they corresponded to those of Case 1 and Case 2 above. In this experiment, a magnetic field was generated for 10 seconds in each position of magnetic field and the positions were then changed alternately by moving the electromagnets. Since the moving speed of the electromagnets was set at 10 cm/s, it took about two seconds to change the positions of magnetic field The flow rate of molten metal was about 2 kg/sec and the rotating speed of the rolls was controlled to 86 rpm for the positions of magnetic field in Case 1 and 37 rpm for the positions of magnetic field in Case 2. As a result, the casting thickness was about 0.95 mm and constant during casting irrespective of the positions of magnetic field and the casting width was about 150 mm and about 300 mm in the positions of magnetic field in Case 1 and Case 2, respectively. Thus it was found that stainless steel sheets with uniform width and good properties can be produced and that the width can be varied substantially even during casting.

What is claimed is:

1. A continuous sheet casting process for producing cast sheets comprising the steps of providing a pair of rolls positioned parallel to and rotating in opposite direction to each other, each of said rolls can be internally cooled and is constructed in a manner that a plurality of paramagnetic material zones and at least three ferromagnetic material zones are alternately combined in the direction of the roll axis, causing all of the ferromagnetic material zones of the two rolls to be opposite to one another, forming magnetic circuits, by the action of magnets positioned outside or inside the rolls, in two places arbitrarily selected in the direction of the roll axis between the ferromagnetic material zones and the magnets which are opposite to one another between the two rolls, continuously supplying molten metal to the gap defined between the rotating rolls while retaining the formed magnetic circuits, and preventing the flow of molten metal to outside the magnetic fields in the direction of the roll axis by the magnetic fields generated between the opposite rolls in the two places, thereby controlling the casting width.

2. A continuous sheet casting process by twin rolls according to claim 1, wherein said magnets are two magnets positioned in two places in the direction of the roll axis and castings with different widths are obtained by moving the two magnets in the direction of the roll axis and, therefore, by changing the interval of magnetic fields for each of different casting operations or during one casting operation.

3. A continuous sheet casting process by twin rolls according to claim 2, wherein said magnets for rolls are electromagnets.

4. A continuous sheet casting process by twin rolls according to claim 1, wherein said magnets for rolls are a plurality of electromagnets, which are positioned for each of all sets of ferromagnetic material zones opposite to one another between the two rolls, and castings with different widths are obtained by changing energized electromagnets and, therefore, by changing the interval of magnetic fields for each of different casting operations or during one casting operation.

5. A twin roll type continuous sheet casting apparatus for producing cast sheets by continuously pouring molten metal into the space defined by a pair of opposite rolls positioned parallel to each other and rolling the poured molten metal by causing it to solidify gradually, in which:

each of said rolls can be internally cooled and is constructed in a manner that at least four paramagnetic material zones and at least three ferromagnetic material zones extending along the full periphery of each roll are combined alternately and integrally in the direction of the roll axis, all of the ferromagnetic material zones of the two rolls positioned parallel to each other are opposite to each other, at least two magnets are positioned outside or inside of the rolls which can magnetize the ferromagnetic material zones opposite to one another between the two rolls by forming a magnetic circuit between the ferromagnetic material zones in two places arbitrarily selected in the direction of the roll axis, and a means for continuously supplying molten metal to the gap defined between the pair of rolls between the ferromagnetic material zones in two places selectively magnetized is Positioned above the two rolls.

6. A twin roll type continuous sheet casting apparatus according to claim 5, wherein said magnets are two magnets positioned in two places in the direction of the roll axis, and a means of changing the places of the two rolls in the direction of the roll axis is included.

7. A twin roll type continuous sheet casting apparatus according to claim 6, wherein said magnets are electromagnets.

8. A twin roll type continuous sheet casting apparatus according to claim 5, wherein said magnets are a plurality of electromagnets, which are positioned for each of all ferromagnetic material zones opposite to one another between the two rolls, and a means of changing energized electromagnets for each of different casting operations or during one casting operation is included.

9. A twin roll type continuous sheet casting apparatus according to claim 5, wherein each of said rolls has ferromagnetic material zones at least in two places on both roll end sides in connection with the middle portion of the roll length serving as the center of symmetry.

10. A twin roll type continuous sheet casting apparatus according to claim 5, wherein said means for continuously supplying molten metal has a nozzle elongated in the direction of the roll axis.

11. Rolls used in a twin roll type continuous sheet casting apparatus for producing cast sheets by continuously pouring molten metal into the space defined by the pair of rolls positioned parallel to each other and rolling the poured molten metal while causing it to solidify gradually, each of said rolls being capable of being internally cooled and being constructed in a manner that at least four paramagnetic material zones and at least three ferromagnetic material zones extending along the full periphery of each roll are combined alternately and integrally in the direction of the axis.

12. Rolls according to claim 11, wherein there are at least two ferromagnetic material zones on both roll end sides in connection with the middle portion of the roll length serving as the center of symmetry.

13. Rolls according to claim 11, wherein the whole surface of each roll is covered with a thin layer of paramagnetic material.

14. Rolls according to claim 11, wherein said thin layer of paramagnetic material is a coated layer.

15. Rolls according to claim 13, wherein said thin layer of paramagnetic material is a thin-walled cylinder put on the peripheral surface of the roll body.

* * * * *